United States Patent [19]

Germershausen et al.

[11] Patent Number: 4,602,553

[45] Date of Patent: Jul. 29, 1986

[54] METHOD OF AND ASSEMBLY FOR FIRING PROJECTILES WITH CONTROLLED GASIFICATION OF A LIQUID PROPELLANT

[75] Inventors: Raimund Germershausen, Düsseldorf; Jochen Schmitt, Schiefbahn; Karlheinz Reinelt, Düsseldorf-Oberkassel, all of Fed. Rep. of Germany

[73] Assignee: Rheinmetall GmbH, Düsseldorf, Fed. Rep. of Germany

[21] Appl. No.: 549,382

[22] Filed: Feb. 10, 1975

Related U.S. Application Data

[63] Continuation-in-part of Ser. No. 242,266, Apr. 10, 1972, abandoned.

[30] Foreign Application Priority Data

Apr. 10, 1971 [DE] Fed. Rep. of Germany ..... 21175495

[51] Int. Cl.[4] ..... F41F 1/04

[52] U.S. Cl. ..... 89/7

[58] Field of Search ..... 89/7, 8; 60/633, 637

[56] References Cited

U.S. PATENT DOCUMENTS 3,690,255 9/1972 Vass et al. ..... 89/7

*Primary Examiner*—Stephen C. Bentley

*Attorney, Agent, or Firm*—Karl F. Ross; Herbert Dubno

[57] ABSTRACT

A projectile seated in a gun barrel is fired by vaporizing a liquid propellant in a loading chamber communicating with the gun barrel through a rising duct. A cluster of filling bodies occupies the entire cross-section of the duct and dips into the liquid propellant within the loading chamber, these bodies forming a multiplicity of passages in which the ignited liquid gasifies upon being driven by its own vapor pressure toward the gun barrel.

9 Claims, 3 Drawing Figures

Figure 1:
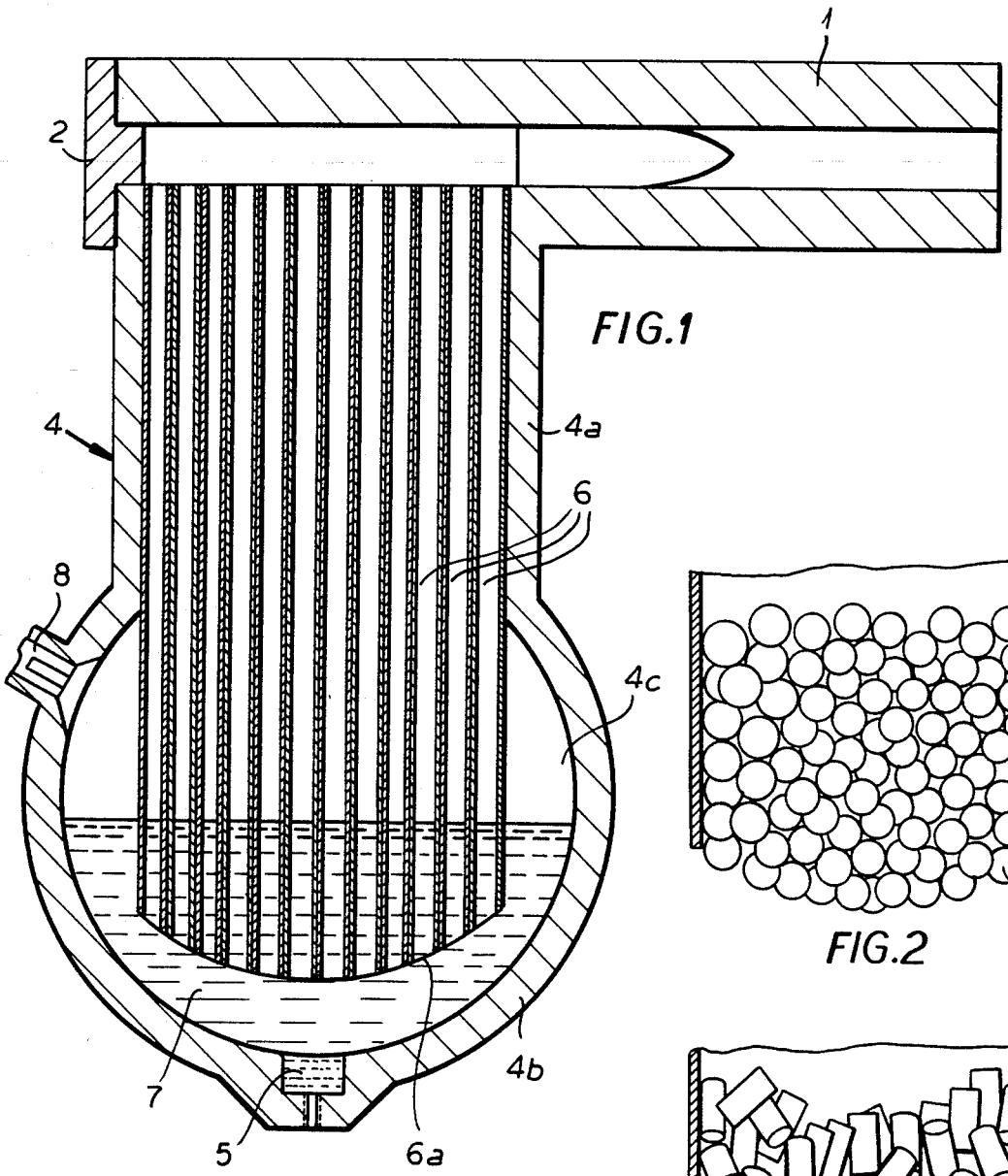

METHOD OF AND ASSEMBLY FOR FIRING PROJECTILES WITH CONTROLLED GASIFICATION OF A LIQUID PROPELLANT

This is a continuation-in-part application of our copending patent application Ser. No. 242,266 filed Apr. 10, 1972, and now abandoned.

The present invention relates to a method of an assembly for firing projectiles from a gun barrel with controlled gasification of a liquid propellant.

When liquid propellants are used for expelling a projectile from the barrel of a firearm other than a rocket launcher, it is generally not desirable to feed the propellant continuously during the combustion; as the pressure in the combustion chamber of such a firearm exceeds that in a rocket launcher by several orders of magnitude while the gasification time for the overall charge is lower by several orders of magnitude, the technical expenditure for the injection pumps and their drive would be too great. For this reason it is taken for granted that in gun barrels the total charge of liquid propellant required for the firing is introduced in its entirety prior to ignition and the start of combustion. In this so-called "bulk-loading", problems occur concerning the reproducibility of the firing mode.

The reproducibility of firing mode, in particular a low scattering of the muzzle velocity of the projectile from shot to shot, is determined essentially by the combustion velocity of the charge, which in turn depends to a great measure upon the surface area available for the transformation of the propellant into its gas phase.

In weapons of this type, into which the entire volume of propellant is introduced prior to ignition, there occurs from ignition up to complete combustion a process of surface formation which does not vary qualitatively from shot to shot yet is subjected quantitatively to strong deviations. This has a consequence a great fluctuation of the muzzle velocity.

The object of our present invention, therefore, is to provide an improved method of and assembly for controlling the gasification of a liquid propellant in a firearm of the type discussed above.

We realize this object, pursuant to an aspect of our invention, by storing the liquid propellant in a loading chamber communicating with the gun barrel, more particularly with a location of that barrel behind a projectile to be fired. The liquid propellant, upon being ignited in the loading chamber, is simultaneously guided by its own vapor pressure toward that location over a multiplicity of generally similar throughgoing passages in which transformation of the propellant into its gaseous phase takes place. Following that transformation, the combined gas volume from all these passages builds up pressure in the gun barrel for ejecting the projectile.

The multiplicity of passages for the guidance of the propellant are formed, according to another aspect of our invention, in a stationary cluster of filling bodies occupying the entire cross-section of a duct connecting the loading chamber with the gun barrel, this cluster extending from above into the loading chamber to a depth sufficient to immerse a lower end of the cluster in the liquid propellant.

The subdivision of the vaporization process into many parallel, simultaneous and generally identical steps has the result that, instead of deviations $\sigma_o$ in the size of the surface of the liquid occurring in the course of a single transformation, we now encounter only the deviations in the mean value of $\sigma_m$ of the surface with multiple parallel transformations affecting the evolution of the shot and thereby also the variations in the muzzle velocity of the projectile.

If n is the number of parallel and simultaneously occurring identical gasification steps, we can write $$\sigma_m = \sigma_o \sqrt{\frac{1}{n}} \; ;$$

this means that, when the gasification process proceeds parallel and simultaneously in 100 passages (n=100), the deviations in the size of the total surface affecting the shot evolution will decrease to 1/10 with reference to the simple process.

The filling bodies may be fixedly interconnected, e.g. by welding or sintering or simply by clamping, so as to form a well-defined structure; they may be constituted by parallel tubes extending the full length of the duct, arrayed in a bundle or by smaller pieces such as short tubular cylinders or balls. Advantageously, the duct is transverse to the gun barrel and terminates flush with a lower wall surface thereof.

Figure 2:
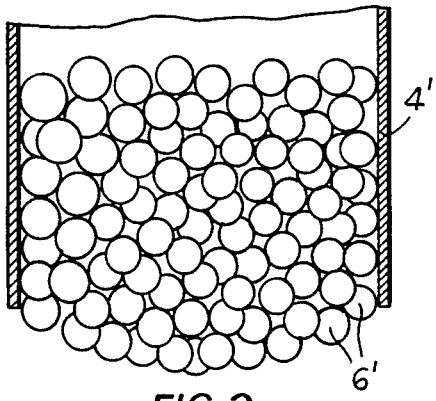
Figure 3:
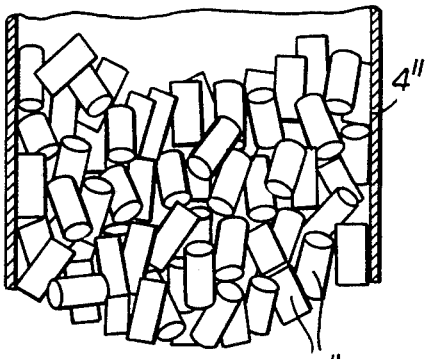

The above and other features of our invention will now be described with reference to the accompanying drawing in which:

FIG. 1 is a somewhat diagrammatic view, in vertical section, of the breech portion of a firearm embodying the present invention; and FIGS. 2 and 3 are fragmentary sectional views showing different filling bodies.

In FIG. 1 we have shown a gun barrel 1 and a breech block 2 which can be formed as a longitudinal or transverse block and which enables the insertion of a bullet 3 in its open position.

An assembly 4 disposed at the rear end of the gun barrel 1 comprises a spherical loading chamber **4*b* connected with that barrel via a rising duct 4*a* perpendicular thereto. The inner diameter of the connecting duct 4*a* is preferably smaller than that of the ball-shaped chamber 4*b***.

The base of the loading chamber **4*b* is reinforced and for the reception of an igniting agent 5** which can be set off either mechanically or electrically.

A major part of the loading chamber **4*b* is occupied by a portion of a cluster of filling bodies 6 in the form of a bundle of parallel, open-ended tubes which are upright so as to extend in the direction of flow from the chamber to the gun barrel 1. The top of the bundle of tubes is flush with the lower wall surface of the gun barrel 1; the lower end 6*a* of the cluster 6 is spaced by a substantially uniform distance from the spherically curved bottom of the loading chamber 4*b*. That distance is so small that the liquid propellant 7 will enter the individual tubes 6 even when at its lowest level. The loading chamber 4*b* is supplied with the proper volume of propellant, of conventional composition, by way of a filling valve 8**. Both monopropellants and bipropellants may be used.

Monopropellants can be burned with the aid of electrical or pyrotechnical igniters because they contain the oxidizer required for combustion. Some known monopropellants, which likewise ignite monergolically, are not combusted but are decomposed without requiring an oxidizer.

Bipropellants are compositions in which the fuel and the oxidizer are fed separately. One distinguishes bipropellants which ignite hypergolically upon contact of the fuel with the oxidizer, in which case no primer or igniter is required, and those wherein under normal temperature and at normal pressure no ignition takes place in spite of contact therebetween and which require an electrical or pyrotechnical igniter in order to combust the fuel-oxidizer mixture.

Since oxidizers are well known, any conventional oxidizer can be used for the present purpose, e.g. ammonium nitrates.

With the exception of the hypergolically ignitable with bipropellants, all liquid propellants are ignited with the primer or igniter 5, we prefer the use of monopropellants for the purpose of the present invention.

With a given propellant volume a constant liquid level and thereby also a constant starting surface of the propellant 7 is presented. The gas bubble created during the activation of the igniter 5 near the bottom of the loading chamber **4*b* presses the liquid columns in the tubes 6 further into these tubes. By roughening the inner wall and by suitably dimensioning the diameter and the length of these tubes, it is assured that the transformation into the gas phase takes place within these tubes, so that only propellant gas but no liquid can enter from them into the gun barrel 1** for driving out the projectile.

Owing to the fact that the combustion is performed almost exclusively within the bundle of tubes 6, we realize the required, totally uniform combustion and thereby a reproducible shot evolution.

Instead of the bundle parallel tubes 6, the duct **4*a* can be filled also with balls 6' of a diameter substantially smaller than the duct width (FIG. 2) or short randomly disposed tubular cylinders 6'' (FIG. 3**) forming a multiplicity of passages therebetween. These filling bodies can be connected together by welding, sintering or similar means before being emplaced in the loading chamber.

While we have disclosed several embodiments of the present invention, it is to be understood that these embodiments are given by way of example only and not in a limiting sense.

We claim:

1. A method of firing a projectile lodged in a gun barrel, comprising the steps of:

storing a liquid propellant in a loading chamber communicating with a location of the gun barrel behind said projectile;

igniting said propellant in said loading chamber;

simultaneously guiding said propellant under its own vapor pressure toward said location over a multiplicity of generally similar throughgoing passages with transformation into its gaseous phase in said passages; and letting the combined gas volume from said passages build up pressure at said location for ejecting the projectile from the gun barrel.

2. In a firearm provided with a gun barrel, a loading chamber adapted to receive a liquid propellant, and a duct connecting said loading chamber with said gun barrel at a location behind a seat for a projectile to be fired by the vaporized propellant upon ignition thereof, the combination therewith of:

a stationary cluster of filling bodies occupying the entire cross-section of said duct and extending from above into said loading chamber to a depth sufficient to immerse a lower end of said cluster in the liquid propellant, said bodies forming a multiplicity of generally similar throughgoing passages extending from said lower end to said gun barrel; and igniting means in said loading chamber for vaporizing said liquid propellant whereby the liquid lodged in the lower end of said cluster is driven under the resulting vapor pressure through said passages for transformation into its gaseous phase within said passages.

3. The combination defined in claim 2 wherein said duct is transverse to said gun barrel and terminates flush with a lower wall surface thereof.

4. The combination defined in claim 3 wherein said cluster of filling bodies is a bundle of parallel tubes extending from below the level of said liquid to said lower wall surface.

5. The combination defined in claim 2 wherein said igniting means is disposed at the bottom of said loading chamber beneath said cluster.

6. The combination defined in claim 5 wherein said loading chamber is generally spherical and has an inner diameter larger than that of said duct.

7. The combination defined in claim 2 wherein said filling bodies are fixedly interconnected.

8. The combination defined in claim 7 wherein said filling bodies are randomly disposed cylinders substantially shorter than said duct.

9. The combination defined in claim 7 wherein said filling bodies are balls of a diameter substantially smaller than the width of said duct.

* * * * *